US009396895B2

(12) United States Patent
Demissy et al.

(10) Patent No.: US 9,396,895 B2
(45) Date of Patent: Jul. 19, 2016

(54) LIGHTWEIGHT CONDUCTOR FOR ELECTRICAL EQUIPMENT AND ELECTRICAL EQUIPMENT INCLUDING AT LEAST ONE SUCH CONDUCTOR

(71) Applicant: ALSTOM Technology Ltd., Baden (CH)

(72) Inventors: Daniel Demissy, St. Bernard de Lacolle (CA); Riyad Kechroud, Montreal (CA); Martin Leger, St-Lazare (CA)

(73) Assignee: ALSTOM Technology Ltd., Baden (CH)

( * ) Notice: Subject to any disclaimer, the term of this patent is extended or adjusted under 35 U.S.C. 154(b) by 363 days.

(21) Appl. No.: 13/652,191

(22) Filed: Oct. 15, 2012

(65) Prior Publication Data

US 2013/0092517 A1 Apr. 18, 2013

(30) Foreign Application Priority Data

Oct. 18, 2011 (FR) ..... 11 59411

(51) Int. Cl.

| | |
|---|---|
| ***H01H 31/00*** | (2006.01) |
| ***H01H 31/02*** | (2006.01) |
| *H01H 1/42* | (2006.01) |
| *H01H 31/28* | (2006.01) |

(52) U.S. Cl.

CPC ..... *H01H 31/026* (2013.01); *H01H 1/42* (2013.01); *H01H 31/28* (2013.01)

(58) Field of Classification Search

CPC ..... H01H 1/42; H01H 31/00; H01H 31/02; H01H 31/023; H01H 31/026; H01H 31/28

USPC ..... 200/48 KB, 48 R, 48 A

See application file for complete search history.

(56) References Cited

U.S. PATENT DOCUMENTS

| | | | | |
|---|---|---|---|---|
| 3,182,145 | A * | 5/1965 | Gorman | 200/48 A |
| 3,206,568 | A * | 9/1965 | Foti | 200/48 A |
| 3,544,741 | A | 12/1970 | Kuhn | |
| 3,959,616 | A * | 5/1976 | Swanson et al. | 200/254 |
| 4,481,387 | A * | 11/1984 | Worrix | 200/48 R |

FOREIGN PATENT DOCUMENTS

| | | |
|---|---|---|
| EP | 0 203 373 | 12/1986 |
| FR | 2 943 451 | 9/2010 |
| WO | 2010/106126 | 9/2010 |

OTHER PUBLICATIONS

French Preliminary Search Report for French Application No. 1159411, dated Jul. 5, 2012.

* cited by examiner

*Primary Examiner* — Renee Luebke
*Assistant Examiner* — Lheiren Mae A Caroc
(74) *Attorney, Agent, or Firm* — Nixon Peabody LLP; Khaled Shami

(57) ABSTRACT

The invention relates to a conductor for electrical equipment, including at least two electrically-conductive material support elements spaced apart from each other along a longitudinal axis (Y) and at least four electrically-conductive material structural sections elongate along the longitudinal axis (Y), curved transversely to the longitudinal axis, and supported by the support elements; wherein the support elements further hold apart in pairs the at least four curved structural sections, the separation maintained between two curved structural sections of a pair defining an open area extending transversely to the longitudinal axis and at least between the support elements, said open area reducing in size progressively and continuously. This conductor may advantageously form a movable contact (blade) of a high-voltage disconnector.

24 Claims, 5 Drawing Sheets

LIGHTWEIGHT CONDUCTOR FOR ELECTRICAL EQUIPMENT AND ELECTRICAL EQUIPMENT INCLUDING AT LEAST ONE SUCH CONDUCTOR

CROSS REFERENCE TO RELATED APPLICATIONS OR PRIORITY CLAIM

This application claims the benefit of French Patent Application No. 11 59411, filed Oct. 18, 2011, the contents of which are incorporated herein by reference in their entirety.

TECHNICAL FIELD

The present invention relates primarily to a conductor for electrical equipment, notably to a movable contact for disconnectors for outdoor high-voltage electrical energy transmission and distribution installations, and more generally to a switch for outdoor high-voltage electrical energy transmission and distribution installations.

The main target application field is high-voltage conductors but the invention may equally be applied to medium-voltage or low-voltage conductors.

The invention relates more particularly to reducing the weight of such conductors.

PRIOR ART

A high-voltage electrical substation includes in particular a set of circuit-breakers and disconnectors.

The disconnector in an electrical substation has a safety function; it is opened after the circuit-breaker has been opened, making it safe to work on the substation.

As known in the art, a disconnector includes a stationary contact and a movable contact, usually called the blade, that is pivotable about an axis. When the disconnector is closed, the movable contact and the stationary contact are in mechanical and electrical contact.

One type of high-voltage disconnector known in the art includes a contact that is movable about an axis and that is substantially horizontal when the disconnector is closed and substantially vertical when the disconnector is open. The movable contact is formed by an assembly of parts joined together and defining an air gap in which a stationary contact is accommodated when the movable contact is moved.

That disconnector is entirely satisfactory in terms of safe operation and efficient conduction of current.

In international patent application WO 2010/106126 the applicant has proposed a high-voltage disconnector of that kind that is furthermore of simplified design.

The need to withstand high thermal stresses obliges designers of disconnectors to oversize the movable contact relative to its current conduction specifications. To be more precise, designers must increase the peripheral length of the movable contact, as for the movable contact of the above-mentioned international application. Doing this increases the external area of said contact, which encourages exchange of heat with the surrounding air. However, increasing the external area of the movable contact (blade) increases its weight. A disconnector must also be highly resistant to earthquakes. The more heavy parts are used, the more this may compromise the ability of a disconnector to withstand earthquakes.

The object of the invention is therefore to propose electrical equipment, more particularly a disconnector of the above-described type, that uses lighter parts, notably a movable contact lighter than those of prior art electrical equipment, at the same time as addressing high thermal constraints.

PRESENTATION OF THE INVENTION

To this end, the invention provides a conductor for electrical equipment, including:

at least two electrically-conductive material support elements spaced apart from each other along a longitudinal axis;

at least four electrically-conductive material structural sections elongate along the longitudinal axis, curved transversely to the longitudinal axis, or curved laterally with respect to the longitudinal axis (or: in a plane perpendicular to the longitudinal axis, the structural sections have a curvature), and supported by the support elements.

According to the invention, the support elements further hold apart in pairs the at least four curved structural sections, the separation maintained between two curved structural sections of a pair defining an open area extending transversely to the longitudinal axis and at least between the support elements, said open area reducing in size progressively and continuously.

The inventors were faced with the constraints applying to a high-voltage disconnector:

when operating, the rise in temperature to which a high-voltage disconnector is subjected must be limited to a threshold;

a disconnector must also resist certain seismic forces, which may be high.

It has been found that the weight of the blade, i.e. the weight of the movable contact of the disconnector, is one of the main negative factors leading to the disconnector being damaged when subjected to seismic shocks, especially when in the open position.

Starting from this observation, the inventors took as their objective reducing the weight of the blade of a high-voltage disconnector as much as possible without it overheating during operation of the disconnector.

They therefore went back to the physical principles applying to any such conductor.

Firstly, it is well known that passing a current through a movable contact generates heat by the Joule effect, which heat is transmitted to the surrounding air and has the effect of varying the density of the air. Upthrust in accordance with Archimedes' principle therefore induces a flow of air. Thus this gravitational force caused by the variation in the air density is the cause of natural convection, also referred to as natural convection, that takes place around a disconnector blade.

The natural convection in question combines two different physical phenomena that are frequently linked. Firstly, there is the phenomenon of convection as such, which consists in a transfer of heat between a solid body (the blade of the disconnector) and the freely moving surrounding air. There is then the second phenomenon, namely the phenomenon of convection motion that corresponds to heat being transferred within the air via convection loops. This motion of the air is characterized by mass flow rates as a function of both the flow cross-section offered to the surrounding air and the speed of the flow. The speed is dictated by the variation in the density of the air towards the upper portion of a disconnector blade. Accelerating the flow of air therefore encourages cooling of the upper portion of the blade, which is the area that is the most highly stressed from the thermal point of view, i.e. that is raised most in temperature.

The inventors then had the idea of adopting an asymmetrical separation between curved structural sections so as to produce a reduction of the air flow cross-section together with different cross-sections of the external and internal structural sections so as to produce an unequal division of electrical resistance between these structural sections and thereby to induce an unequal flow of current in them, which causes differential heating between their facing surfaces. By virtue of the same physical principle as referred to above, this leads to convection motion of the air between these curved structural section surfaces. This motion combined with the effect of free convection and the Venturi effect together encourage cooling on the lateral walls, more particularly in the upper portion of the conductor (blade). Compared to the prior art, these combined cooling effects make it possible to reduce the cross-section of a disconnector blade for the same rated current. Accordingly, the invention enables reduction of the weight of the blade of a high-voltage disconnector and consequently reduction of the stresses on the disconnector if it is subjected to seismic shocks, for example.

This conductor is particularly suitable for producing a movable contact for a disconnector.

The conductor preferably includes two support elements, each placed at one longitudinal end of the conductor.

According to one advantageous feature, the conductor of the invention includes at least two electrical contact elements adapted to come into contact with a separate electrical contact to provide an electrical connection, each of the contact elements being fastened to one of the exterior curved structural sections of the conductor.

The contact elements are preferably identical and each constituted of a part bent in half and adapted to come into contact with the separate contact.

The open area is advantageously identical for each pair of curved structural sections of the at least four curved structural sections.

To simplify manufacture, all the curved structural sections may have a curvature that is simple or complex.

In a currently preferred embodiment of the invention the external structural sections have end portions defining additional curvature with a local increase in thickness, and the internal structural sections have end portions defining an additional surface of inflexion extended by additional curvature with a local increase in thickness.

The external structural sections are advantageously identical to each other and the internal structural sections are also advantageously identical to each other.

In one embodiment of the invention the support element is rigid.

In another embodiment of the invention each support element is flexible in the direction transverse to its longitudinal axis so as to enable the distance D between the exterior curved structural sections to be varied.

Resilient means may then advantageously also be provided, which resilient means are placed in each support element to maintain mutual separation of the exterior curved structural sections with a particular force. The resilient means are preferably constituted of a compression coil spring.

Each support element is advantageously itself a structural section.

A structural section of the support elements may include an open tubular portion providing the flexibility of the structural section, the resilient means being placed in the opening of this tubular portion, which also bears against the interior curved structural sections. This produces a simple and compact embodiment.

To simplify manufacture, all the structural sections are preferably produced by extrusion, for example from an aluminum alloy.

The conductor of the invention preferably forms a movable contact of a high-voltage disconnector adapted to be hinged at one of its longitudinal ends to pivot on an insulating support.

The present invention also provides electrical equipment including at least one conductor of the present invention adapted to come into contact with at least one contact of the equipment.

The conductor may be movable and cooperate with at least one stationary contact, or it may be stationary and cooperate with at least one movable contact.

In one embodiment, the conductor may be stationary and establish contact between two contacts of the equipment.

The contact or contacts with which the conductor comes into contact is or are generally U-shaped, for example.

If the electrical equipment of the invention forms a disconnector including at least one stationary contact, the conductor may form a movable contact and a support element may be mounted on and hinged by pivoting to an insulating support at one of its longitudinal ends, the exterior curved structural sections supporting the contact elements adapted to come into contact with the stationary contact at least at the other longitudinal end.

For example, each branch of the stationary contact is extended by a lug bent inwards so as to be substantially parallel to the branch of the U shape to which it is fastened, said lug being adapted to come into mechanical contact with at least one contact element of the movable contact.

Return means are advantageously disposed between the lug and the branch to which it is fastened to urge the lug inwards towards the movable contact when it is in place.

BRIEF DESCRIPTION OF THE DRAWINGS

The present invention can be better understood in the light of the following description and the appended drawings, in which.

DETAILED DESCRIPTION OF PARTICULAR EMBODIMENTS

In the following description, the conductor of the present invention is described as used in a high-voltage disconnector. It is to be understood that the conductor of the present invention may be used in any type of electrical equipment in which a conductor is required. Furthermore, the conductor is described as movable, but it is to be understood that a stationary conductor is within the scope of the present invention.

Figure 1A:
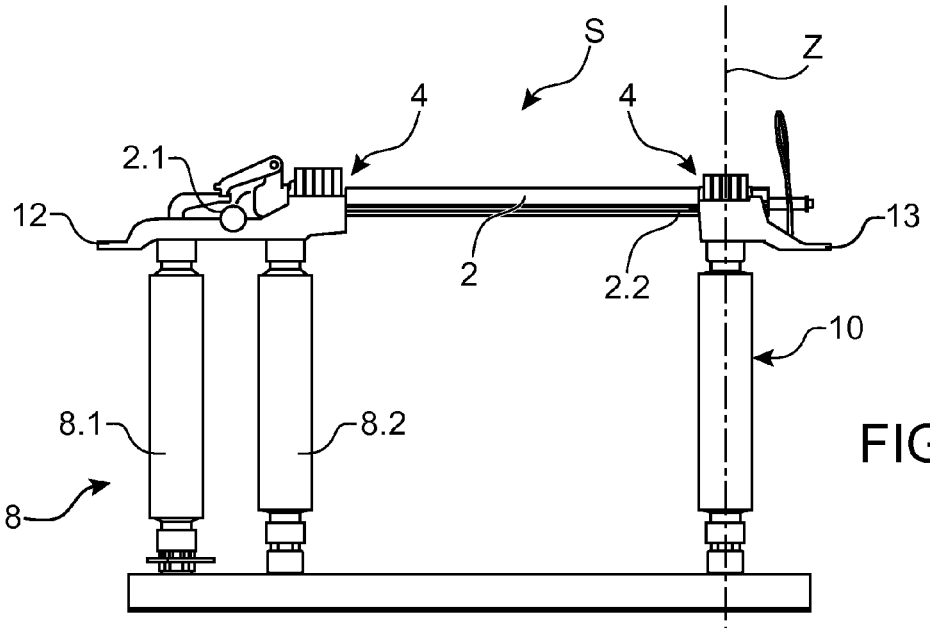
FIG. 1A is a side view of a disconnector of one embodiment of the present invention in a closed position.
Figure 1B:
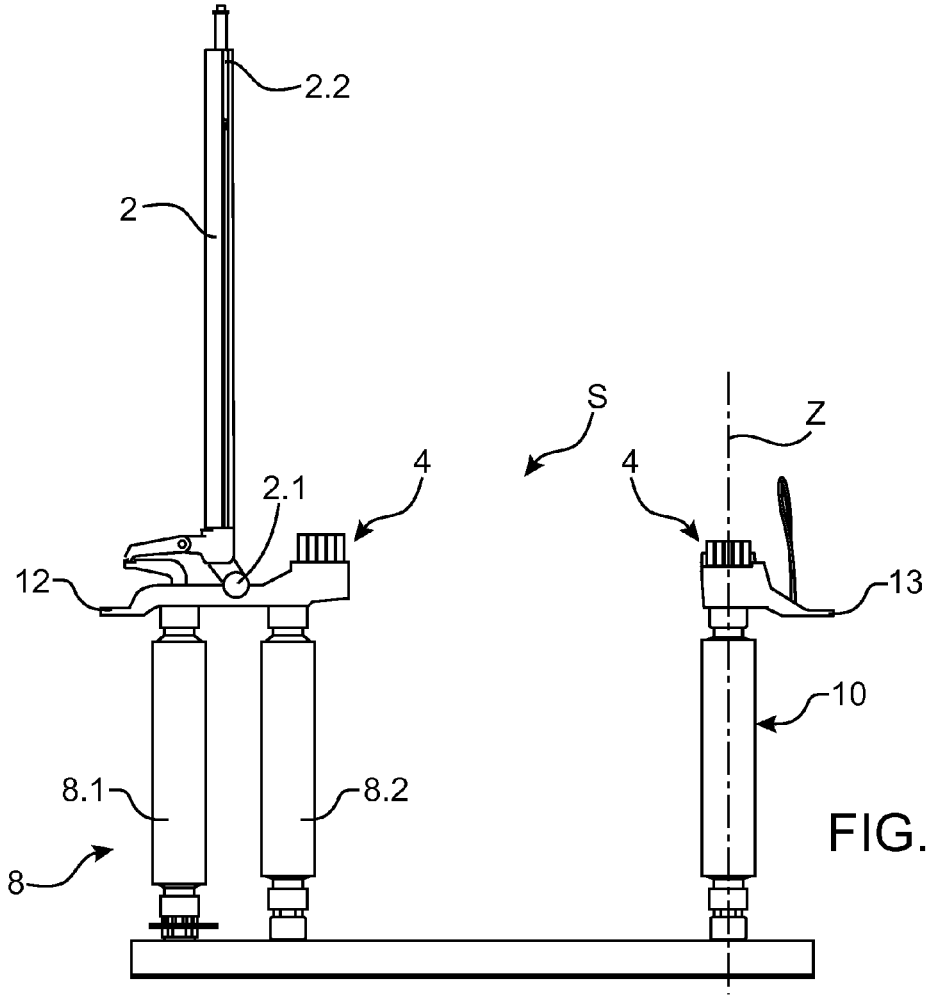
FIG. 1B is a side view of the disconnector from FIG. 1A in an open position.

In FIGS. 1A and 1B there may be seen an example of a high-voltage disconnector S, typically for a voltage of the order of 300 kilovolts (kV), to which the conductor of the invention may be applied. The disconnector S includes a movable contact 2 formed by the conductor of the present invention, two stationary contacts 4, and insulating supports 8, 10.

Note that in the example shown the conductor 2 of the invention forming the movable contact of the disconnector is elongate along the longitudinal axis Y.

In the description below, the stationary longitudinal axes X and Z are defined by convention, the longitudinal axis X being the horizontal axis in FIG. 2B and the axis Z being the vertical axis in FIG. 2B. Accordingly, in the closed position (FIG. 1A), the conductor 2 defines with the stationary axes X and Z an orthogonal system of axes.

In a high-voltage disconnector S, the movable contact 2 of the present invention is usually referred to as the blade. The contact 2 of the invention is mounted to be movable in pivoting between a closed position (FIG. 1A) and an open position (FIG. 1B), these two positions respectively defining closed and open positions of the disconnector. To be more precise, the movable contact 2 is mounted on and hinged to the insulating support 8, one stationary contact 4 is mounted on and fastened to the insulating support 8, and the other stationary contact 4 is mounted on and fastened to the insulating support 10. In the example shown, the insulating support 8 of the movable contact 2 is formed of two columns 8.1, 8.2 supporting the articulation mechanism of the movable contact 2. The insulating support 10 is for its part formed of a single column.

The movable contact 2 is able to pivot about an axis substantially orthogonal to the plane of the page, whereupon the movable contact may pass from a substantially horizontal position (FIG. 1A) when the disconnector is closed to a substantially vertical position (FIG. 1B) when the disconnector S is open.

In the disconnector S shown, the movable contact 2 of the invention is electrically connected by way of a separate electrical contact to a high-voltage electrical network via a substantially horizontal connection 12. The stationary contacts 4 are for their part connected to the network by a connection 13 of similar construction to the connection 12. Accordingly, when the disconnector S is in the closed position (FIG. 1A), the current coming from the high-voltage distribution network may pass from one of the connections, for example the connection 12, to the other, for example the connection 13.

It is to be understood that the present invention also applies to a disconnector with only one stationary contact 4.

The actuation mechanism of the disconnector is of a type known in the art and is not described in detail. In the example shown, it includes a flat spiral spring adapted to balance the blade 2 of the disconnector. The insulating column 8.1 also forms a control link for controlling movement of the blade (movable contact) 2.

The disconnector shown in FIGS. 1A and 1B has two stationary contacts 4, each adapted to be in mechanical contact with one end of the movable contact. In the example shown, the two stationary contacts 4 are of similar structure: thus only one of them is described in detail below.

A stationary contact 4 has a substantially U-shaped cross-section forming a jaw, the two substantially parallel branches of which are electrically conductive, these two branches defining an air gap in which the movable contact 2 is positioned when the disconnector is in the closed position, electrical conduction occurring between the movable contact and these parallel branches. To be more precise, as clearly shown in FIGS. 2A and 2B, the stationary contact 4 includes a U-shaped part 30 fastened to the insulating support 10 by its bottom 30.1, this part 30 having two substantially parallel branches 30.2, 30.3 between which the movable contact 2 is positioned.

Each branch 30.2, 30.3 is extended by a lug 32.2, 32.3 bent inwards and adapted to come into contact with a contact element 16.2, 16.1 of the movable contact 2 as described below.

Resilient means 34 of the coil spring type are advantageously provided between each lug 32.2, 32.3 and the corresponding branch 30.2, 30.3, thereby pushing the lug 32.2, 32.3 inwards. This improves the electrical contact between the lug and the associated contact element.

In the example shown, the lugs 32.2, 32.3 are screwed to the branches 30.2, 30.3, respectively. The branch and the lug could also be produced in one piece by bending. In this example the parts 30.2, 30.3 would be duplicated so that the loop effect would tend to push the lugs 32.2, 32.3 towards the movable contact without bending back the branches 30.2, 30.3, which would reduce the contact pressure.

The movable contact 2 of the present invention is described in detail below with more particular reference to FIGS. 3 to 5.

The movable contact 2 of the invention, while allowing electrical current to flow between the connections 12 and 13, has a much lower weight than those used until now in high-voltage disconnectors.

Figure 3:
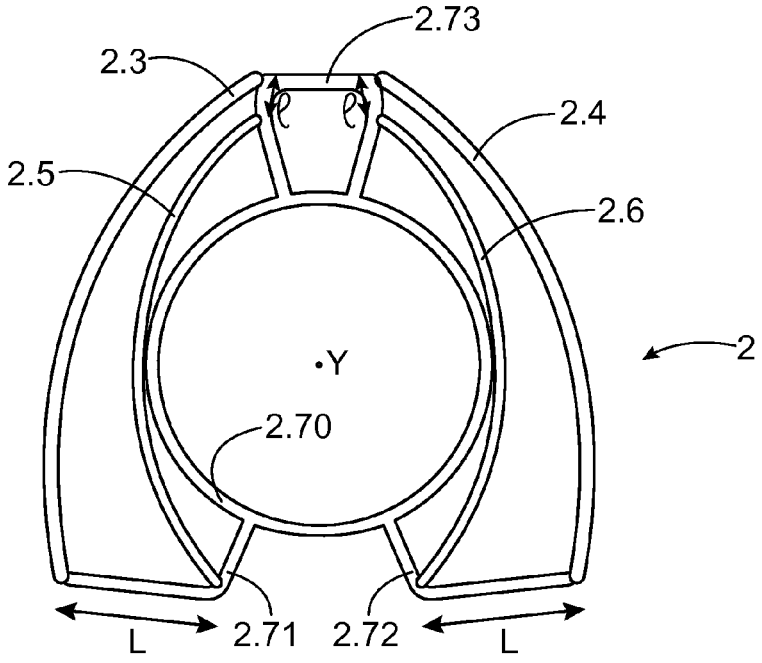
FIG. 3 is a view in cross-section of a conductor of one embodiment of the invention without the contact elements.

FIG. 3 is a view in cross-section of a conductor 2 of the invention forming the movable contact of the high-voltage disconnector from FIGS. 1A and 1B described above. The section plane is for example at the end 2.2 of the conductor 2 in an area outside the area of the contact branches of the stationary contact 4.

The pivoting movable conductor (blade) 2 comprises four curved structural sections 2.3, 2.4, 2.5, 2.6 of electrically-conductive material that are elongate along the longitudinal axis Y, that are curved transversely to the longitudinal axis, and that are supported by at least two structural section support elements also of conductive material and spaced from each other along the longitudinal axis Y. In the plane of FIG. 3, which is perpendicular to longitudinal axis Y, each of the structural sections has a curvature. Only one structural section support element 2.7 is shown. All the structural sections 2.3, 2.4, 2.5, 2.6, 2.7 are preferably made of aluminum or aluminum alloy and manufactured by direct extrusion. There may be provided aluminum alloy structural section support elements 2.7, advantageously produced by extrusion, and aluminum curved structural sections 2.3, 2.4, 2.5, 2.6, also advantageously produced by extrusion. It goes without saying that in the context of the invention all the shapes of the structural sections may be produced by bending or by any other machining process.

According to the invention, the structural section support elements 2.7 also hold apart pairs of structural sections of the four curved structural sections, namely the pair 2.3, 2.5 and the pair 2.4, 2.6, respectively. The spacing between two curved structural sections of a pair defines an open area that extends transversely to the longitudinal axis Y and at least between the two structural section support elements, which open area shrinks progressively and continuously.

Figure 4:
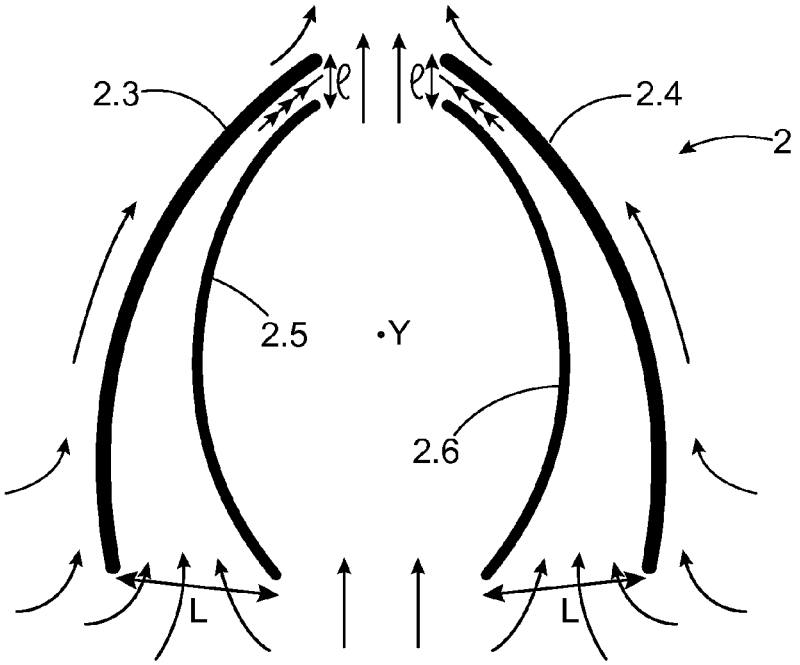
FIG. 4 is a diagrammatic view in cross-section of just the curved structural sections of a conductor of the FIG. 3 embodiment, showing the circulation of air around the conductor.
Figure 5:
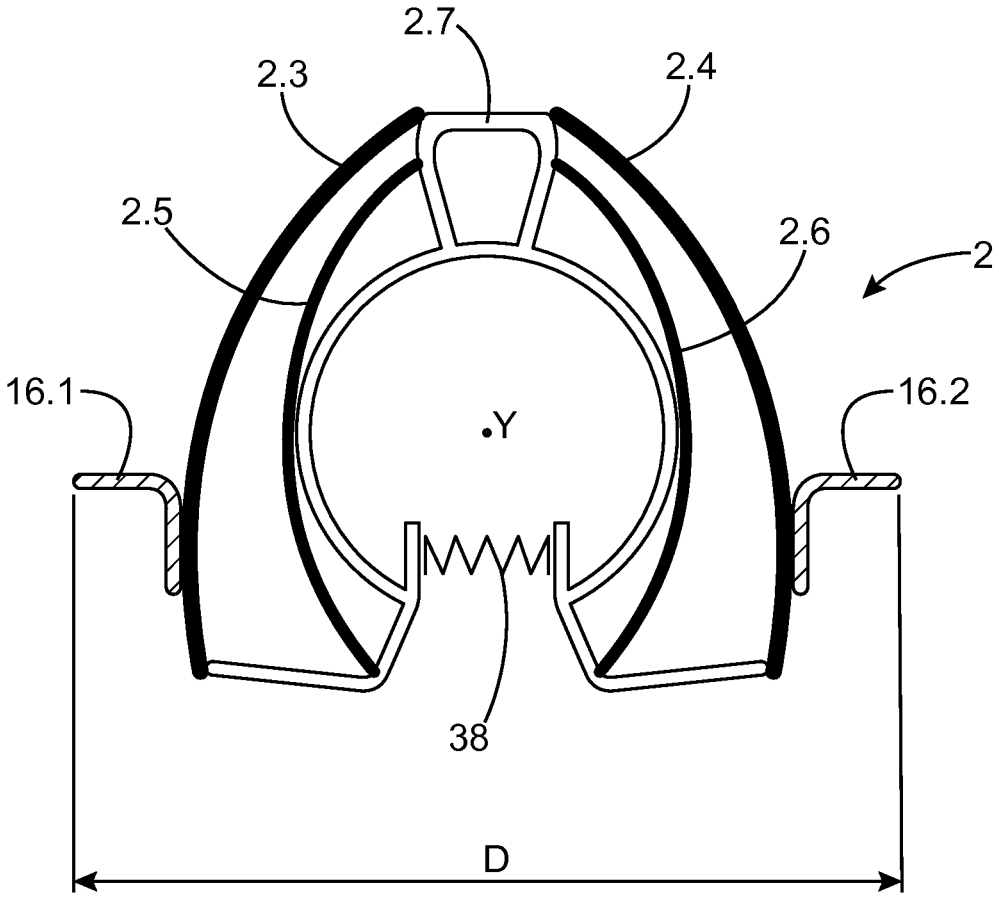
FIG. 5 is a view in cross-section of a conductor of the FIG. 3 embodiment with the contact elements, according to a different construction.

The simple curvature of the curved structural sections 2.3, 2.4, 2.5, 2.6 and the structural section support elements 2.7 define aerodynamic shapes chosen to encourage air from the surroundings to flow over them, as seen better in FIG. 4. Accordingly, as shown by means of arrows in this figure, the curved structural sections 2.3, 2.4, 2.5, 2.6 held by the at least two structural section support elements 2.7 act in accordance with the invention to define a system for guiding the air upwards with the air flow cross-section between structural sections of the same pair reducing in size towards the upper portion of the conductor. In other words, the four curved structural sections 2.3, 2.4, 2.5, 2.6 make it possible to direct the flow of air while simultaneously serving as electrically conductive elements. The at least two structural section support elements 2.7 both retain or hold the curved structural sections 2.3, 2.4, 2.5, 2.6 and distribute energy from the transfer side of the movable contact (blade) 2 to the stationary contact (jaw) 4.

In the example shown, all the curved structural sections 2.3, 2.4, 2.5, 2.6 extend over the entire length of the structural section of the conductor 2. The two structural section support elements 2.7 are arranged at the two ends of the conductor 2. If necessary, and as a function of the stiffness required of the conductor 2, a plurality of other discrete support elements may also be placed along the conductor 2. Such a structure for the conductor of the invention has the advantage of enabling simple production by extrusion and cutting to length. Furthermore, this makes it possible to have a substantially constant conduction cross-section. The structural section support element 2.7 is fastened to the curved structural sections 2.3, 2.4, 2.5, 2.6 at intervals, i.e. by each structural section support element, thus making it possible to stiffen the conductor 2. The structural sections 2.3, 2.4, 2.5, 2.6 and the support elements 2.7 are assembled in accordance with the present invention by welding, but other mechanical assembly processes may be used, such as riveting or other processes.

Where the blade 2 is pivoted, the section is closed to the flow of air, but the current flow cross-section is preferably larger.

The symmetrical structural section support element 2.7 shown in FIG. 3 advantageously has a tubular central portion 2.70 on which the two interior curved structural sections 2.5, 2.6 bear and thus retain their original curvature whatever forces are applied. The lower portion of the structural section support element 2.7 comprises two identical lugs 2.71 and 2.72 oriented in opposite directions. Each of these lugs 2.71, 2.72 has fastened thereto the lower edges of the two curved structural sections 2.3, 2.5 or 2.4, 2.6 of a pair. The dimension L at the ends of the lugs 2.71, 2.72 defines the maximum distance between the two curved structural sections 2.3, 2.5 or 2.4, 2.6 of a pair. The upper portion 2.73 of the structural section support element 2.7 has a substantially trapezoidal shape with a base to which the upper edges of the two curved structural sections 2.3, 2.5 or 2.4, 2.6 of a pair are fastened. The dimension (height) of the trapezoidal base of the upper portion 2.73 of the structural section defines the minimum separation between the two curved structural sections 2.3, 2.5 or 2.4, 2.6 of a pair. Accordingly, the progressive and continuous reduction in size according to the invention of the cross-section between the curved structural sections of the same pair occurs on passing from the maximum dimension L to the minimum dimension over the entire length of these curved structural sections along the longitudinal axis Y and between the structural section support elements 2.7. With such reduction in size of the cross-section according to the invention, a Venturi effect may be obtained between the two curved structural sections 2.3, 2.5 or 2.4, 2.6 of a pair, as shown in FIG. 4. The arrows in FIG. 4 symbolize the flow of air around and inside the structural sections. The Venturi effect is seen more clearly at the level of the cross-section of smallest dimension 1, the acceleration of the air at this level being symbolized by the arrows being more dense.

Thus the conductor 2 comprises at least two spaced-apart structural section support elements 2.7 and has an elongate general shape hinged at one of its longitudinal ends 2.1 to the first insulating support 8. The other of its longitudinal ends 2.2 opposite the end 2.1 is provided with contact elements 16.1, 16.2 adapted to cooperate with a stationary contact 4 placed on the insulating support 10. Here these contact elements 16.1, 16.2 are constituted of parts bent in half to an "L" shape. The contact elements 16.1 and 16.2 are bolted to the elements 2.3 and 2.4. FIG. 5 shows the arrangement of these contact elements 16.1, 16.2 on the exterior curved structural sections 2.3 and 2.4. Although this is not shown, the structural section support element 2.7 placed at the level of the first longitudinal end 2.1 also includes contact elements to cooperate with the other stationary contact 4 placed on the other insulating support 8.

Figure 2A:
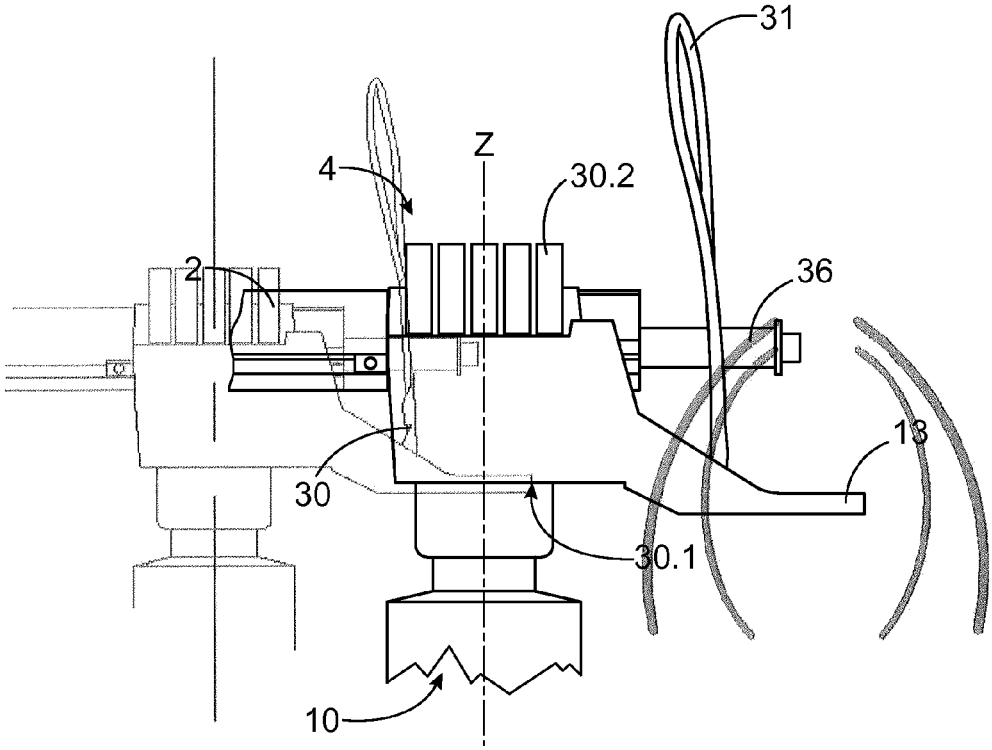
FIGS. 2A and 2B are views to a larger scale of the stationary contact of the high-voltage disconnector S from FIGS. 1A and 1B, respectively from the side and from the front (which is on the right-hand side in FIG. 2A)
Figure 2B:
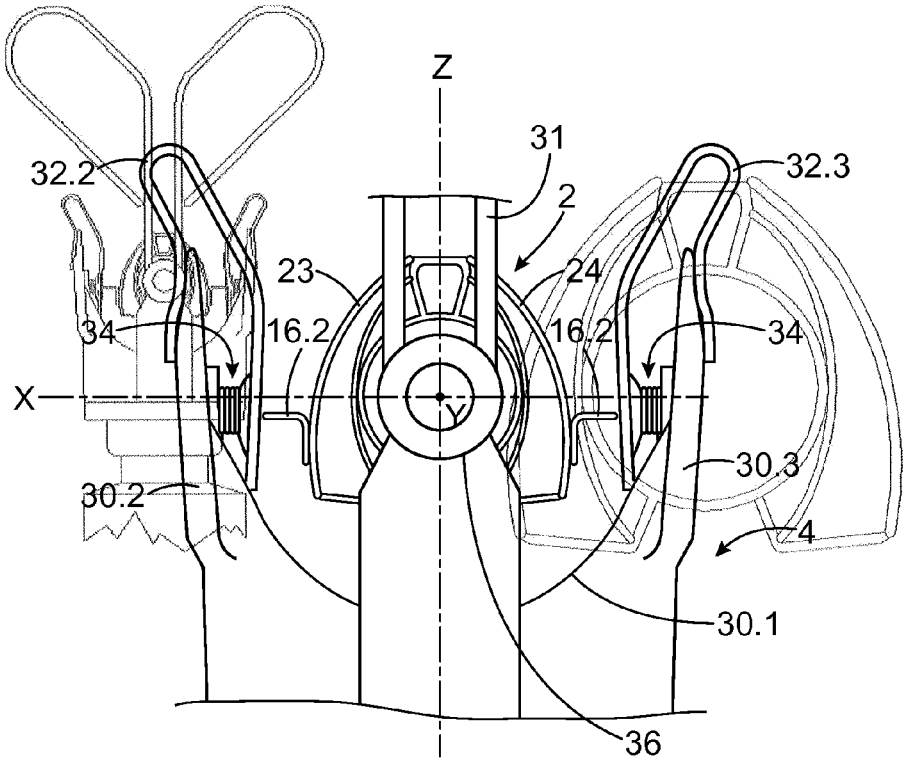

FIG. 2B shows the physical contact between the contact elements 16.1, 16.2 of the movable conductor 2 of the invention in the closed position of the disconnector: the contact elements 16.1, 16.2 each bear on a respective lug 32.2, 32.3 of the stationary contact 4. FIG. 2B shows only two contact elements 16.1, 16.2 and two branches 30.2, 30.3 of the stationary contact 4. As seen better in side view in FIG. 2A, the stationary contact 4 has five contact branches on each side. Here, although this is not shown, the movable contact 2 of the invention includes two contact elements 16.1 and 16.2 on each side associated with each of the branches. The two contact elements 16.1, 16.2 of the movable conductor 2 are long enough to extend over the length of approximately nine or ten stationary contact branches 4. This ensures permanent contact between the stationary contact 4 and the movable conductor 2 if a short-circuit causes movement along the axis Y. It is to be understood that stationary contacts having a different number of contact branches come within the scope of the present invention. The contact elements 16.1, 16.2 and the lugs 32.2, 32.3 are preferably of silver-plated copper and the branches 30.2, 30.3 of the U are produced in aluminum alloy, for example.

The operation of the disconnector of the present invention is similar to that of a disconnector of known type and is not described in detail. Above-mentioned patent application WO 2010/106126 referred to in the preamble may advantageously be consulted, notably for an explanation of the flow of the short-circuit current from the movable contact to the stationary contact via the two contact elements 16.1, 16.2 when the disconnector is closed.

In the example shown in FIG. 3, the tubular portion 2.70 of the movable contact 2 of the invention is rigid. Accordingly, it is not deformed by the forces exerted on it when the disconnector operates and for its part the stationary contact 4 can be deformed during operation to adapt to the size of the movable contact 2. The deformation of the stationary contact 4 is obtained by virtue of the flexible lugs 32.2, 32.3 and the return coil springs 34. Accordingly, the size of the air gap increases when the movable contact 2 penetrates the stationary contact 4 and is adapted to the transverse dimension of the movable contact 2, which is defined by the distance between the radially outwardly oriented ends of the contact elements 16.1, 16.2, each fastened to the exterior curved structural sections 2.3, 2.4. Very good electrical contact is obtained in this way between the movable conductor 2 of the invention and a stationary contact 4, even at very high voltages.

Alternatively, it may be the movable contact 2 that can be deformed, in particular by modification of its transverse dimension. This variant is shown in FIG. 5: here the structural section support element 2.7 is designed to be flexible transversely to the longitudinal axis Y. To provide this flexibility, substantially the same structural section shape and dimensions may be used as in FIG. 3, except for the opening of the tubular portion 2.7, preferably in its lower portion, i.e. in the portion substantially where the contact elements 16.1, 16.2 are placed. It is then the intrinsic strength of the material constituting the structural section 2.7 that generates the contact pressure between the contact elements 16.1, 16.2 and the stationary contact elements 4. Thus the dimension D of the conductor 2 of the invention transversely to the longitudinal axis Y may be modified and may be adapted as a function of the size of the stationary contact 4 with which it has to cooperate. Resilient means 38, of the compression coil spring type, may advantageously be placed inside the flexible structural section support element 2.7 in order to apply a particular force to maintain mutual separation of the contact elements 16.1, 16.2 with this particular force. Retaining means (not shown) are advantageously provided to prevent the compression coil spring 38 escaping from the structural section support element 2.7 when the disconnector is operating. The design of the stationary contact 4 may be simplified by enabling this transverse flexibility of the movable contact 2 by mutual separation of the contact elements 16.1, 16.2.

Finally, as usual and as shown in FIGS. 2A and 2B, abutment means are preferably provided on the axis Y to limit the retrograde movement of the structural section support element 2.7 during an electrical short-circuit. These means are formed by the curved end of the movable beam 36 of the movable contact 2, which is adapted to abut against spark arresters 31.

By virtue of the curved shape of the structural sections and the distance between them decreasing progressively and continuously from the bottom to the top, the invention that has just been described enables acceleration of the air surrounding the conductor combined with an effect of free convection and a Venturi effect, and consequently increased cooling of the most thermally stressed conductor parts. Consequently, all other things being equal, reducing heating of the conductor in this way makes it possible to reduce its weight.

The inventors consider that, by means of the invention, it is possible to envisage a weight reduction of up to 50% for a high-voltage disconnector blade made of aluminum.

By reducing the weight of a conductor it is possible to use less robust actuators, especially in high-voltage electrical equipment.

By means of the invention, the inventors moreover envisage producing a disconnector with a blade constituted by the conductor of the invention for a high-voltage network operating at a voltage of the order of 500 kV with the same type of actuators used for existing disconnectors for a network operating at a voltage of the order of 300 kV.

Other improvements and embodiments may be envisaged without departing from the scope of the invention.

As indicated above, the conductor of the invention may be suitable for use in any type of electrical equipment to provide an intermittent or continuous electrical contact. In particular, the conductor of the invention may be a stationary contact and may be permanently installed. In a permanently installed stationary configuration, the ability to shape the conductor by virtue of its intrinsic flexibility and the use of resilient separating means between contact elements, the geometry of the conductor may be adapted as required and permanently to suit other components to which it is electrically connected.

If the conductor is adapted to connect electrically two portions of electrical equipment, it may include contact elements at its two longitudinal ends, the contact elements at one end being in contact with one portion of the electrical equipment and the contact elements at the other longitudinal end being in contact with the other portion of the electrical equipment. Under such circumstances, the current flows in the longitudinal direction from one longitudinal end to the other.

It is to be understood that if the conductor is movable, the present invention is not limited to a contact that is movable by pivoting, but applies equally to a contact that is movable in translation and to a contact that is movable in translation and/or by pivoting.

It is also to be understood that a conductor of the present invention may include more than two contact elements.

Electrical equipment in accordance with the present invention thus has a lower weight than prior art equipment, in particular disconnectors. Because of this weight reduction, the ability of a disconnector of the invention to resist high seismic forces is increased.

Although described in relation to only four curved structural sections, a conductor of the invention may include a greater number thereof, more particularly to increase its nominal current capacity.

Finally, although in the example shown the curved structural sections all have simple curvature, in the context of the invention providing a plurality of curvatures for the same structural section may be envisaged consistent with continuous and progressive reduction in size of the flow cross-section for air from the surroundings. More generally, more complex structural section shapes may be used provided that they are aerodynamic and that they encourage the flow of air as described above.

Figure 6:
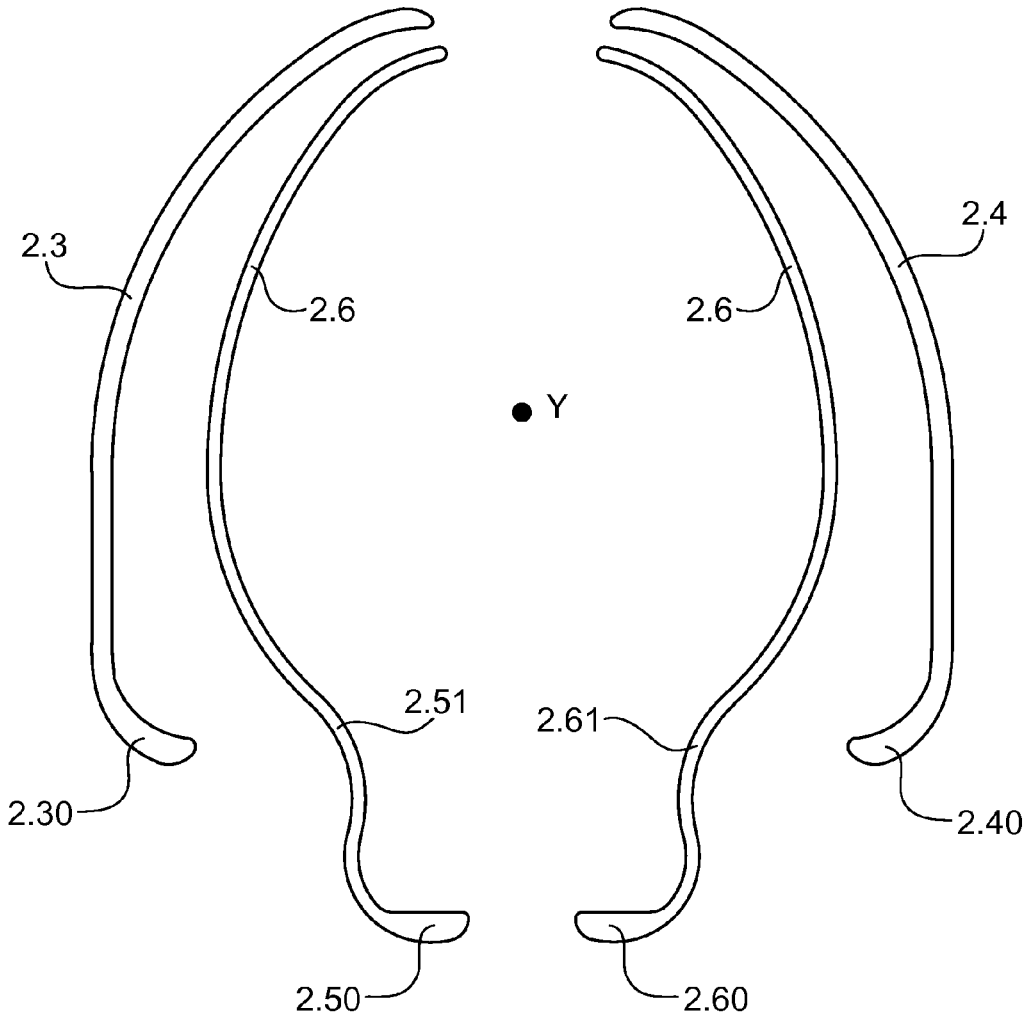
FIG. 6 is a diagrammatic view in cross-section of just the curved structural sections of a conductor of a preferred embodiment of the invention.

The preferred embodiment as envisaged at present is that shown in FIG. 6. The four structural sections 2.3, 2.4, 2.5, 2.6 of the invention here have a more complex shape in their lower portion, i.e. in their lowermost portion in the horizontally installed configuration of the disconnector blade 2. To be more precise, with structural elements as shown in FIG. 6, the inventors envisage producing a blade 2 for a disconnector having the same mass currently adapted to withstand a voltage of 330 kV but for a voltage of 550 kV at a nominal current of 4000 amps (A) and a short-circuit current of 80 kiloamps (kA). This general shape, which might be referred to as a "dog's head" profile, therefore differs from the shapes of the structural sections in FIG. 4 as follows:

an additional curvature with a local increase in thickness for the respective end portions 2.30, 2.40 of the external structural sections 2.3, 2.4, which incidentally are identical;

an additional surface of inflection 2.51, 2.61 extended by an additional curvature with a local increase in thickness of the respective end portions of the internal structural sections 2.5, 2.6, which incidentally are identical.

Digital simulation tests using the Ansys® 12.1 software on a high-voltage disconnector blade 2 with the "dog's head" general shape of the structural elements 2.3, 2.4, 2.5, 2.6 of FIG. 6 have been carried out successfully to verify mechanical strength, resistance to electromagnetic interference, to rated short-circuit current, dielectric strength, heat resistance and correct flow of air around the blade 2. In particular, these tests have clearly demonstrated that the Venturi effect is clearly achieved at the reduced outlet cross-section (high acceleration of the air in the area with the reduced dimension l). These tests have also clearly shown that the maximum electrical stresses at the level of the additional thickness end portions 2.30, 2.40, 2.50, 2.60 are less than 3.0 kilovolts per millimeter (kV/mm).

The weight reduction of the order of 50% envisaged by the inventors is for structural sections as shown in FIG. 4 compared to the round structural sections usually employed for electrical equipment, and for the same current flowing through said equipment. As explained above, this weight reduction of the order of 50% is obviously advantageous if the electrical equipment is subjected to seismic forces. It also has advantages for applications in which a conductor weight and/ or material saving is required. For example, it may be beneficial to have such a reduction for busbars, i.e. current conducting bars interconnecting electrical equipment. Accordingly, for copper-based conductors as usually employed, producing them in accordance with the invention from extruded copper structural sections may be envisaged, which may generate significant manufacturing economies given the constant increase in the price of copper.

Although described above with reference to high-voltage electrical equipment, to be more precise a high-voltage disconnector blade, the invention may equally well be applied to low-voltage or medium-voltage equipment, for example a set of busbars.

The invention claimed is:

1. A conductor for electrical equipment, including:

at least two electrically-conductive material support elements spaced apart from each other along a longitudinal axis;

at least four electrically-conductive material structural sections elongate along the longitudinal axis, supported by the support elements, each of said structural sections having a curvature, in a plane perpendicular to the longitudinal axis;

wherein the support elements further hold apart pairs of the at least four curved structural sections, the separation maintained between two curved structural sections of a pair defining an open area extending transversely to the longitudinal axis and at least between the support elements, said open area reducing in size progressively and continuously, thus guiding air upwards with an air flow cross-section between structural sections of a same pair reducing in size towards an upper portion of the conductor, the at least four curved structural sections being arranged to include at least two exterior curved structural sections.

2. A conductor according to claim 1, including two support elements each placed at one longitudinal end of the conductor.

3. A conductor according to claim 1, including at least two electrical contact elements adapted to come into contact with a separate electrical contact to provide an electrical connection, wherein each of the contact elements is fastened to one of the exterior curved structural sections of the conductor.

4. A conductor according to claim 3, wherein the contact elements are identical and each constituted of a part bent in half and adapted to come into contact with the separate contact.

5. A conductor according to claim 1, wherein the open area is identical for each pair of curved structural sections of the at least four curved structural sections.

6. A conductor according to claim 1, wherein all the curved structural sections have curvature that is simple or complex.

7. A conductor according to claim 1, wherein the exterior curved structural sections have end portions defining additional curvature with a local increase in thickness, and the internal structural sections have end portions defining an additional surface of inflexion extended by additional curvature with a local increase in thickness.

8. A conductor according to claim 1, wherein the exterior curved structural sections are identical to each other and the internal structural sections are also identical to each other.

9. A conductor according to claim 1, wherein the support element is rigid.

10. A conductor according to claim 1, wherein each support element is flexible in the direction transverse to its longitudinal axis so as to enable a distance D between the exterior curved structural sections to be varied.

11. A conductor according to claim 10, further including resilient means placed in each support element to maintain mutual separation of the exterior curved structural sections with a particular force.

12. A conductor according to claim 11, wherein the resilient means are constituted of a compression coil spring.

13. A conductor according to claim 11, wherein each support element is itself a structural section, said structural section including an open tubular portion providing the flexibility of the structural section, the resilient means being placed in the opening of this tubular portion, which also bears against the interior curved structural sections.

14. A conductor according to claim 1, wherein each support element is itself a structural section.

15. A conductor according to claim 1, wherein all the structural sections are produced by extrusion, for example from an aluminum alloy.

16. A conductor according to claim 1, forming a movable contact of a high-voltage disconnector adapted to be hinged at one of its longitudinal ends to pivot on an insulating support.

17. High-voltage electrical equipment including at least one conductor according to claim 1, adapted to come into contact with at least one contact of the equipment.

18. Electrical equipment according to claim 17, wherein the conductor is movable and cooperates with at least one stationary contact, or is stationary and cooperates with at least one movable contact.

19. Electrical equipment according to claim 17, wherein the conductor is stationary and brings two contacts of the equipment into contact.

20. Electrical equipment according to claim 17, wherein the contact or contacts with which the conductor comes into contact is or are generally U-shaped.

21. Electrical equipment according to claim 17, forming a disconnector including at least one stationary contact and wherein the conductor forms a movable contact, a support element being mounted on and hinged to pivot on an insulating support at one of its longitudinal ends, the exterior curved structural sections supporting the contact elements adapted to come into contact with the stationary contact at least at the other longitudinal end.

22. Electrical equipment according to claim 21, wherein each branch of the at least one stationary contact is extended by a lug bent inwards so as to be substantially parallel to the branch of a U shape to which it is fastened, said lug being adapted to come into mechanical contact with at least one contact element of the movable contact.

23. Electrical equipment according to claim 22, wherein return means are disposed between the lug and the branch to which it is fastened to urge the lug inwards towards the movable contact when it is in place.

24. A conductor for electrical equipment, including:

at least two electrically-conductive material support elements spaced apart from each other along a longitudinal axis, each of the at least two electrically-conductive material support elements including an upper portion that forms an upper portion of the conductor;

at least four electrically-conductive material structural sections elongate along the longitudinal axis, supported by the support elements, each of said structural sections having a curvature, in a plane perpendicular to the longitudinal axis;

wherein the support elements further hold apart in pairs the at least four curved structural sections, the separation maintained between two curved structural sections of a pair defining an open area extending transversely to the longitudinal axis and at least between the support elements, said open area reducing in size progressively and continuously, the structural sections of a same pair reducing in size in a direction toward the upper portion of the conductor, the at least four curved structural sections arranged to include at least two exterior curved structural sections, wherein the conductor is a movable contact.

* * * * *